US005265399A

United States Patent [19]

Niskanen et al.

[11] Patent Number: 5,265,399

[45] Date of Patent: Nov. 30, 1993

[54] METHOD AND APPARATUS FOR WRAPPING ROLLS, PAPER ROLLS IN PARTICULAR, IN A WRAPPER SHEET

[75] Inventors: Tapio Niskanen; Hannu Nieminen, both of Lahti, Finland

[73] Assignee: Valmet Paper Macinery, Incorporated, Helsinki, Finland

[21] Appl. No.: 831,881

[22] Filed: Feb. 6, 1992

[30] Foreign Application Priority Data

Feb. 12, 1991 [FI] Finland ..... 910665

[51] Int. Cl.[5] ..... B65B 11/04; B65B 51/10; B65B 51/20; B65B 51/22

[52] U.S. Cl. ..... 53/463; 53/465; 53/214; 53/372.9

[58] Field of Search ..... 53/463, 465, 214, 211, 53/141, 372.9, 373.7

[56] References Cited

U.S. PATENT DOCUMENTS

| | | | |
|---|---|---|---|
| 1,573,669 | 2/1926 | Bolingbroke | 53/214 |
| 2,638,725 | 5/1953 | Hurter et al. | 53/214 X |
| 3,342,014 | 9/1967 | Prager | 53/372.9 X |
| 3,374,598 | 3/1968 | Piroutek | 53/463 X |
| 3,411,269 | 11/1968 | Karr | 53/372.9 |
| 3,875,723 | 4/1975 | Sundin | 53/30 |
| 4,693,056 | 9/1987 | Raszewski | 53/463 X |
| 4,716,709 | 1/1988 | Lamb, Sr. et al. | 53/339 |
| 4,864,802 | 9/1989 | D'Angelo | 53/463 X |
| 4,945,707 | 8/1990 | Cosmo | 53/399 |

FOREIGN PATENT DOCUMENTS

| | | | |
|---|---|---|---|
| 62988 | 12/1982 | Finland | 51/2 |
| 63712 | 4/1983 | Finland | 11/4 |
| 441819 | 10/1904 | Sweden | 11/4 |
| 1052568 | 12/1966 | United Kingdom . | |
| WO 83/01765 | 5/1983 | World Int. Prop. O. . | |

*Primary Examiner*—Horace M. Culver
*Attorney, Agent, or Firm*—Cohen, Pontani, Lieberman, Pavane

[57] ABSTRACT

The present invention concerns a method and assembly for wrapping paper rolls in a wrapping material (12). The method employs such wrapping material that incorporates a heat-meltable laminate layer (26). According to the method the paper roll (23) is rotated on support rolls (13), the wrapper (12) is guided about the roll (23) so that the laminate layer (26) comes against the roll, the wrapper (12) is adhered to the roll by applying energy onto the wrapper in order to attain the melting of the plastic film laminate, whereby the wrapper (12) adheres to the roll (23), and the roll (23) being rotated is wrapped into at least one turn of the wrapper. According to the invention the wrapper laminate layer is melted from the laminate side to adhere the wrapper to the roll being wrapped, and when necessary, the area and/or energy density of melting energy application onto the wrapper material is varied in the direction of the center axis of the roll in order to achieve a desired pattern of adherence. The assembly according to the invention comprises a melting unit, which is divided in at least two melting zones, and said melting zones can be controlled partially or entirely independently from each other and can be directed against the surface of the wrapper material (12) in order to produce the thermal effect necessary for at least a partial melting of said laminate layer (26).

22 Claims, 7 Drawing Sheets

METHOD AND APPARATUS FOR WRAPPING ROLLS, PAPER ROLLS IN PARTICULAR, IN A WRAPPER SHEET

FIELD OF THE INVENTION

The present invention relates to a method for wrapping rolls, paper rolls in particular, in a wrapper sheet.

According to the present method, the roll is wrapped in a wrapper material, whose surface is coated with a heat-meltable laminate layer, by rotating the paper roll on support rolls or an equivalent rotating apparatus and guiding the wrapper sheet about the roll so that the side coated with the laminate layer faces the roll. The wrapper is attached onto the roll by converting the laminate layer to a partially or fully fluid or semi-solid state, whereby it acts as a glue.

The present invention also relates to an assembly for wrapping a roll, a paper roll in particular, in a wrapper by rotating the roll.

BACKGROUND OF THE INVENTION

In the paper industry, paper rolls are packaged in wrappers sealed with end headers. The wrapper sheet conventionally employed is comprised of several layers, frequently in a combination of kraft wrapper-plastic film laminate-kraft wrapper (e.g. Kraftliner 100 $g/m^2$+PE 40 $g/m^2$+Kraftliner 100 $g/m^2$). The purpose of the packaging system is to protect the roll against humidity, physical damage and to provide the facility of mechanical handling without damaging the roll itself. Further, two or more small rolls are often packed in a single package, whereby the packaging system must be sufficiently strong to keep the package together.

Suitable packaging is related to several factors. Such factors include efficient initial gluing for achieving a tight wrap and a smooth wrapper surface without wrinkles to keep the wrapper straight and tensioned during roll wrapping. For rolls that must be free from the initial adhesive stripe as defined by customer specification, wrap tension is attained by the use of a guide-about apparatus. The quality of such wrapping remains inferior, however. Successful folding of the wrapper sheet requires correct application of pressure by the crimping arms and proper moisture content (8 . . . 11%) of the wrap. At a correct level of moisture content, the fold becomes sharp and the folded edge remains parallel with the roll end. The moisture content of the wrapper often drops further during storage, whereby the wrapper becomes tight and small wrinkles are smoothed away.

In present methods, the wrapper sheet is often sealed using a hot-melt or cold-setting glue. Gluing takes place by spraying glue stripes onto the wrap, whereby the wrapper is adhered to the roll over the width (3 . . . 5 mm) of the glue stripes. Also known in the art are implementations based on hot-melt gluing that use a wrapping material having a layer of heat-meltable laminate on the wrap. The U.S. Pat. No. 4,716,709, for example, describes the method outlined in the introductory part of this text, in which method the start end and the finish end of the wrapper sheet are sealed to the roll by melting the polyethyene film coat of the wrapping material. The plastic film laminate acts both as a moisture barrier and a glue layer. Melting in accordance with U.S. Pat. No. 4,716,709 takes place with the help of a heater bar which is pressed against the paper layer of the wrap.

A problem in the above described methods is posed by the small area of glue adherence. Having a small area of glue adherence lowers the durability and moisture barrier characteristics of the wrap. When paper rolls are stacked above one another, the highest wear of the wrapper is concentrated to the angle of the wrapper at the corner of the roll end and roll circumference, where a small air pocket (earmark) unavoidably remains. This occurs during the folding of the wrapper at points where the wrapper sheet remains detached from the roll during the wrap-about and consequently does not fold sufficiently sharply parallel to the roll end. Furthermore, both hot-melt and cold glue applicator apparatuses require frequent servicing due to their complicated structure. Therefore, wrapping costs become a dominating factor in the total costs of roll packaging.

OBJECT OF THE INVENTION

It is an object of the present invention to overcome disadvantages hampering the prior-art designs and to achieve a novel method and a novel assembly for wrapping rolls, paper rolls in particular, in a wrap.

SUMMARY OF THE INVENTION

The method according to the invention, in which the wrapper sheet is hot-melt glued in accordance with the U.S. Pat. No. 4,716,709 on the roll, is based on the concept of adhering the wrapper on the roll being wrapped also during roll wrapping. Thus, at least a portion of the plastic film laminate surface between the start end and the finish end of the wrapper sheet is melted in order to attach the plastic film laminate to the roll being wrapped in this portion. When necessary, the application area of melting energy is altered appropriately in the direction substantially parallel to the center axis of the roll during wrapping to attain a desired glue adherence pattern.

The assembly according to the invention comprises means for rotating the roll, at least one wrapper material roll containing wrapper material whose surface is coated with a laminate layer of heat-meltable material, said wrapper material roll being rotatable about its center axis, means for guiding the wrapper material from the wrapper material roll about the roll to be wrapped, means for adhering said wrapper material to the surface of the roll to be wrapped, comprising a melting unit with at least two melting zones, which can be controlled independently from each other and can be directed against the surface of the wrapper material in order to produce the thermal effect necessary for at least a partial melting of said laminate layer, and means for severing the wrapper material upon completion of the wrapping operation.

According to the invention, the wrapping material has a multilayer composition in which the plastic film laminate is comprised of a polymer material possibly complemented with additives. Typical heat-meltable bonding polymers are, for example, polyolefins such as polypropylene and particularly polyethylene. Besides its primary adhesive properties, the plastic film laminate or one or more of its layers also act as a moisture barrier.

The term melting in the context of this patent application is used to mean the conversion of the coat into a partially or entirely fluid or semi-solid state in which it acts as a glue, that is, with an adhering property that makes it stick to the paper roll, wrapping material or similar surface to be glued. The melting process is advantageously carried out in accordance with the invention prior to the entrance of the wrapper into the pressing nip.

The invention also permits the use of suitable waxes and similar materials as the heat-meltable coat material.

The wrapping material is melted from the laminate side, that is, the melting energy is applied or transferred to the wrapping material from the laminate side. This is an advantageous approach, because if the introduction of the melting energy into the laminate to be activated should be attempted from the kraft sheet side, energy would effectively be absorbed in the kraft sheet, which would appreciably complicate the arrangement of effective energy introduction. The present invention aims at large adhering areas and sufficiently rapid throughput times of paper roll wrapping. Practical experiences from energy introduction via the kraft sheet side have proven this approach incapable of satisfying the criteria of throughput goals.

The melting of the laminate layer can be implemented in a number of alternative ways. An advantageous method is by way of radiation heating using, e.g., infrared radiation, but such methods as hot-air jets, flame manifolds, ultrasound transducers, lasers, microwave sources, heated steel bars, heated steel rolls and similar means can be used as well.

An essential requirement according to the invention is that the melting process is controllable by zones in a desired manner, whereby such a zonal control permits the formation of desired adhesive patterns and handling of different widths of wrapping materials (using typical zone widths of 10 . . . 500 mm). For this purpose, the means for wrapper sealing in the assembly according to the present invention comprise a melting unit divided into at least two melting zones which can be controlled partially or entirely independently from each other and which can be directed against the surface of the wrapper in order to produce the thermal effect necessary for at least a partial melting of the plastic film laminate. The melting zones are advantageously arranged adjacent in the direction of and aligned parallel to the center axis of the rolls. At least two melting zones are provided; it is preferred, however, to have between 5 and 50. A higher number of the melting zones permits greater definition in the formation of the melting pattern.

According to a preferred embodiment of the invention, the melting zones of the melting unit use infra-red emitters as the melting elements.

Power control means of the melting zones permit the thermal effect imposed by the heating zones on the wrapping material to be adjusted in the direction of the center axis of the paper roll in order to achieve a desired melting pattern. Zonal control is based on the adjustment of the melting energy application area and/or output level and/or combination of these. Therefore, the control can be implemented by way of several different control elements and methods. Such possibilities are offered, for example, by power control of the zones, distance control of the zones and/or the wrapping material backing, partial or total gating of energy emitted from the zones as well as the deflection of energy emitted from the zones. The zones can also be physically shifted with respect to the paper roll being wrapped with the help of appropriate shifting means. The shifting can take place longitudinally along or transversely to the wrapper web, or alternatively, obliquely to the web. The zonal control is not, however, limited to the above described methods, but rather, all other prior-art and advancing zonal control methods are feasible within the scope of the present invention.

Zonal control can be performed as a continuous process during roll wrapping and/or presetting the energy transferring assembly prior to the wrapping process.

The desired adhesive pattern can be formed to consist of points, stripes, or alternatively, of a homogeneously sealed area. The method according to the present invention is advantageously carried out using the last one of these alternatives. In a preferred embodiment of the invention, in which at least two turns of wrapper are wrapped about the paper roll, the wrapper is then sealed during the first turn of the wrapper only by its center part. During the second wrapping turn the adhesive pattern is widened in steps or continuously until it reaches the edge of the wrapper. Thus, the wrapper is sealed during the second wrapping turn at least for a part of the turn over its entire width. When necessary, the roll is further wrapped by a third turn that is advantageously sealed over its entire width. This wrapping scheme prevents the wrapper from adhering to the roll end, whereby it could damage the roll end in the case the inner header does not fully cover the roll head.

The invention provides significant benefits, and a specific value of the scheme is gained from its capability of attaining the required temperature extremely rapidly and of offering an easy alignment of the heating effect emitted by the zonally controlled melting unit.

DESCRIPTION OF THE DRAWINGS

The invention is next examined in greater detail with the help of the attached drawings, in which.

DETAILED DESCRIPTION OF THE PRESENTLY PREFERRED EMBODIMENTS

Figure 1:
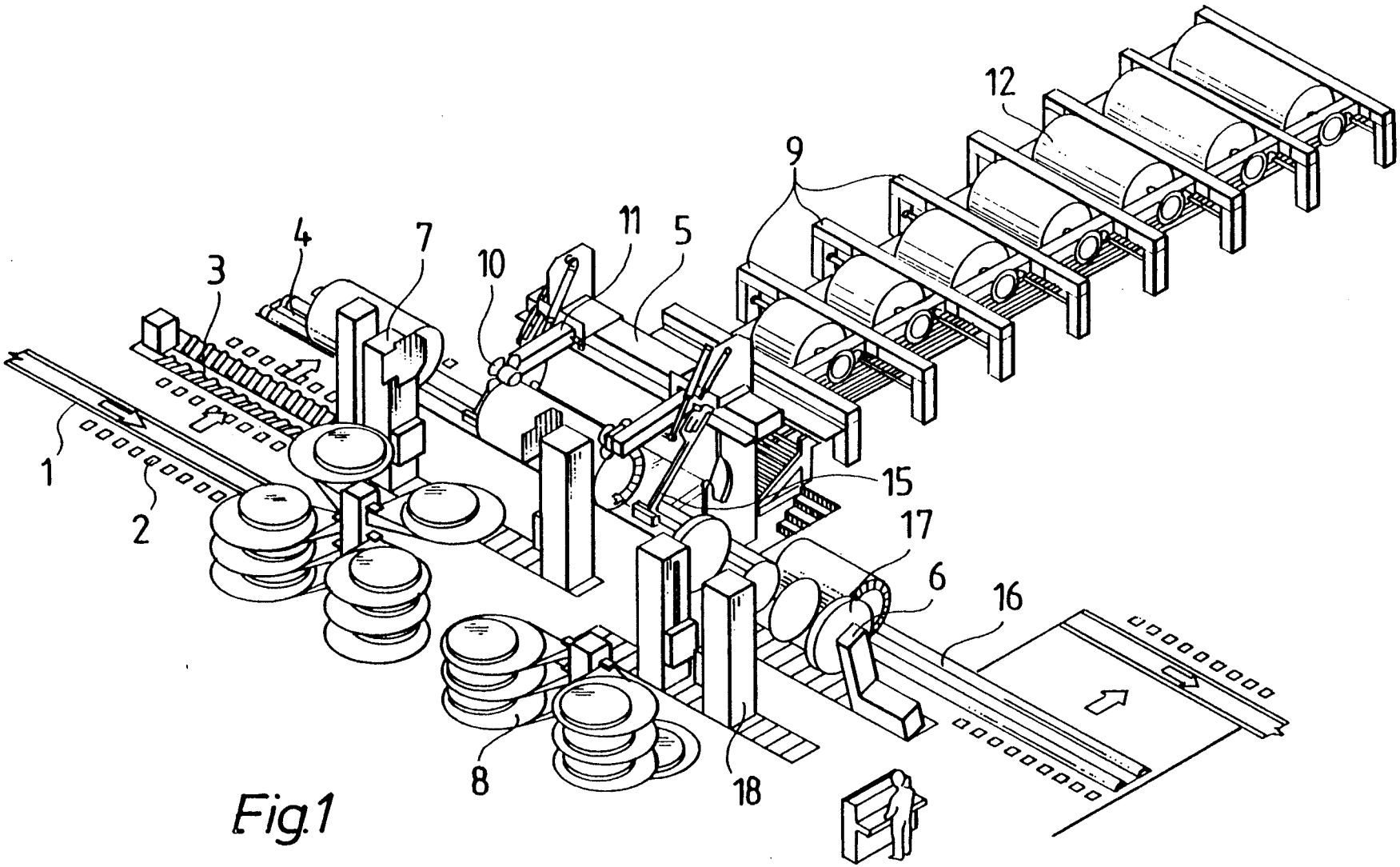
FIG. 1 shows a roll packaging line in a perspective view.

The rolls are transferred on a conveyor 1 toward the packaging line. Each roll awaits at the end of the conveyor until a pusher 2 is enabled to transfer the roll to a centering station 3 where the roll is identified, centered, weighed and its dimensions measured. In addition, the system computes the necessary packaging parameters from the data measured by the centering station.

From the centering station 3 the roll is transferred onto a stepping conveyor 4. Along this conveyor the rolls are transferred in steps first to a wrapping station 5 and further to an end header pressing station 6. On the wrapping station 5 the inner header placing arms 7 first press the inner header against the roll head. Header holding arms 15 are lowered and a header holder platen is pushed outward. The inner headers are sorted by their diameter on header dispensing shelves 8. The machine operator typically loads the header dispensing shelves 8 and wrapper dispensing stations 9 latest when the packaging line is halted. On the basis of data received from the centering station 3, the program selects an optimal wrapper 12 for each roll from one of the wrapper dispensing stations 9.

Figure 2:
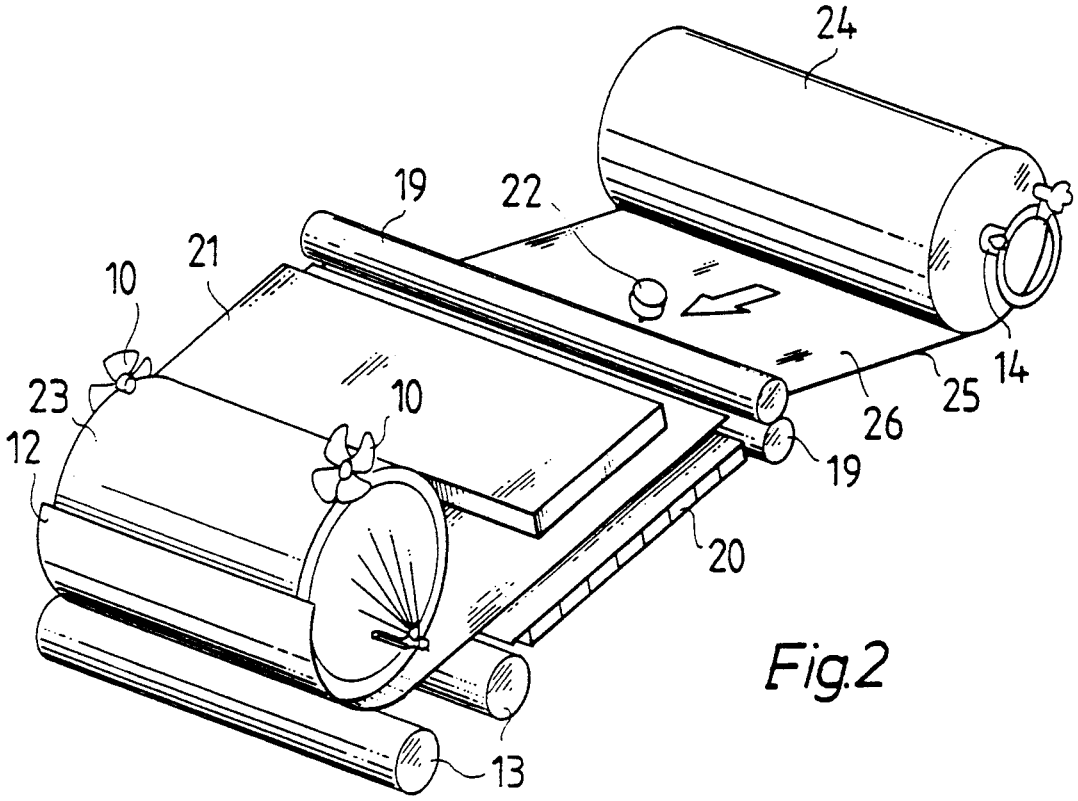
FIG. 2 shows correspondingly a wrapping station in a perspective view.

From the wrapping station 5 the crimping units move toward the roll until the header holder platens can keep the inner header in place. Crimping vanes 10 start to rotate and a crimping arm 11 is lowered onto the roll. As is illustrated in FIG. 2, the wrapper 12 is fed from a wrapper roll 24 via the nip between two pressing rolls 19 along a feed table 20 and under the roll 23 to be wrapped. The wrapper 12 employed in the exemplifying embodiment is comprised of two layers forming a composition of kraft wrapper 25 with plastic film laminate 26 (e.g. Kraftliner 250 $g/m^2$+polyethene 40 $g/m^2$). The reference number 22 denotes a guide of the wrapper web. A melting unit 21 above the wrapper web 12 heats the plastic film laminate of the wrapper web 12 so as to adhere the wrapper to the roll 23. During roll wrapping the travel of the wrapper web 12 is braked with the help of web tension control elements 14 in order to obtain a tightly wrapped package. When the wrapper web 12 has reached the top of the roll 23, the rotating crimping vanes 10 fold the wrapper edges overhanging the roll ends down parallel with the roll end. The packages contain typically two or three turns of wrapper.

The melting assembly 21 employed in the invention is in the exemplifying embodiment arranged in front of support rolls 13 on which the roll is rotated.

Figure 4:
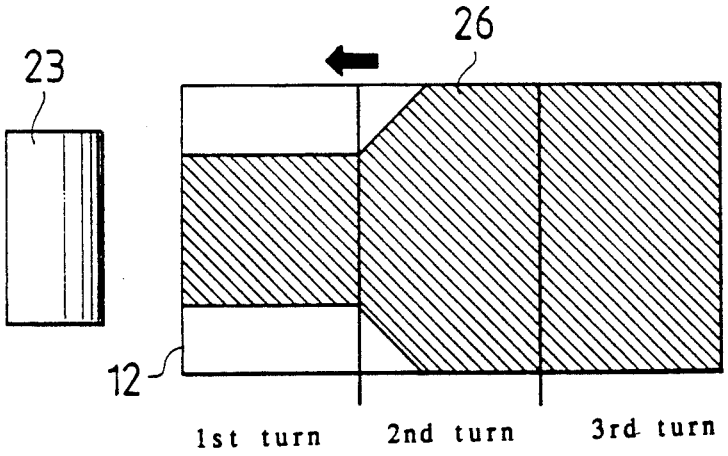
FIG. 4 shows the form of a preferred adhesive pattern.

As noted above, the method according to the invention is implemented most appropriately by forming the desired adhesive pattern with the help of the zonal control of the melting unit. For example, the wrapper is sealed during the first roll wrapping turn only at the center of the wrapper, while the second wrapper turn, and when necessary also the third wrapper turn, is sealed over the entire wrapper width as illustrated in FIG. 4 (the hatched area designates melted wrapper laminate). The melting pattern is widened during the second turn up to the edges of the wrapper.

The above described wrapping scheme prevents the wrapper from adhering to the roll end and thereby damaging the roll end in the case the inner header for some reason fails to fully cover the roll head.

Figure 3:
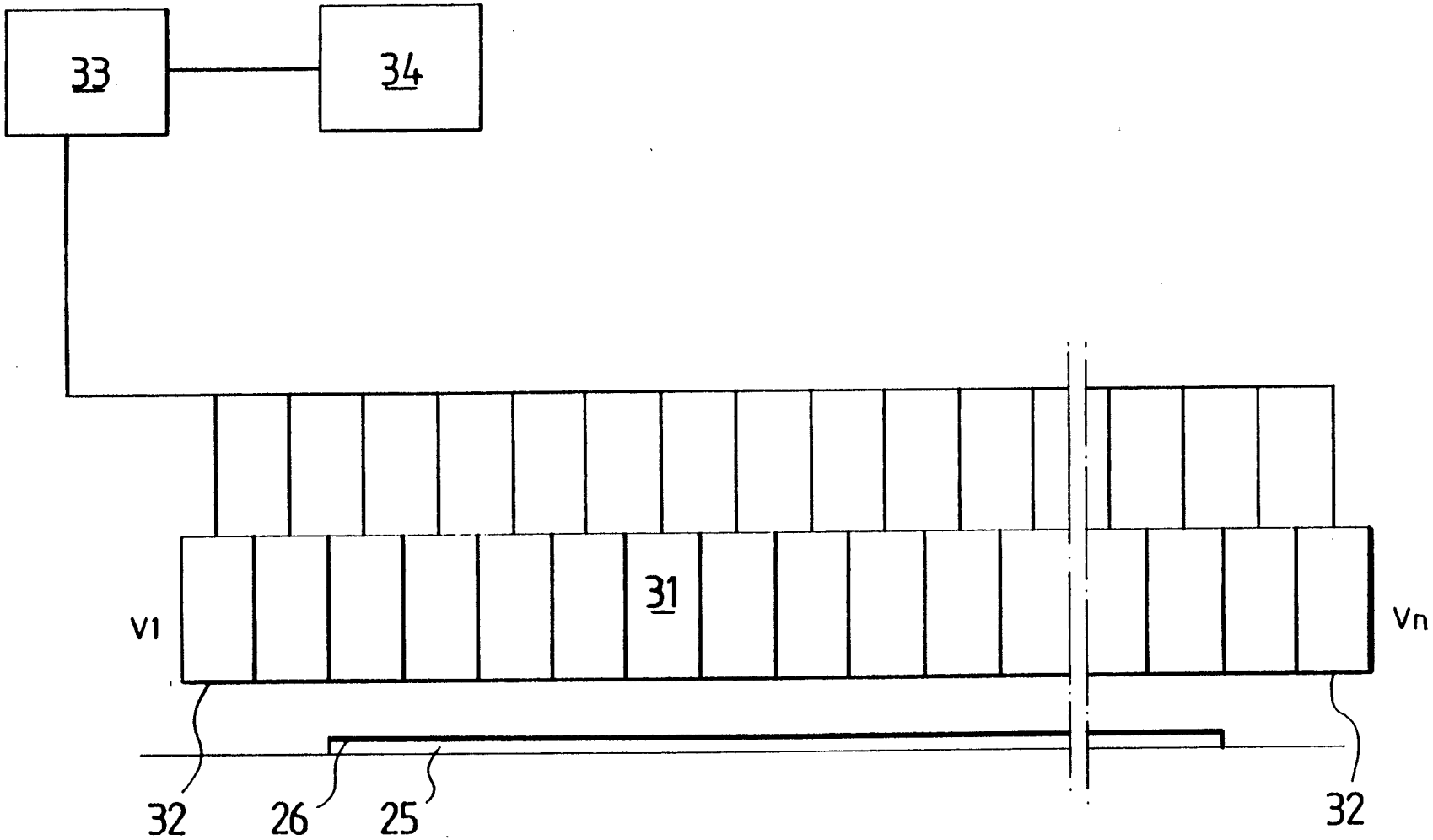
FIG. 3 shows diagrammatically the design of a melting unit employed in the invention

FIG. 3 illustrates the construction of a melting unit suitable for zonal control. The melting unit 31 is divided in the wrapper cross direction into blocks or zones $V_1$ . . . $V_n$ the number of which is n. Each zone $V_n$ of the melting unit contains a melting element 32, each of which is directly connected to input power supply and control units 33 and 34. These units make it possible to control the power level (0 . . . 100%) applied onto the wrapper via each melting unit, thus affecting the melting profile produced by the entire melting unit. The melting until 31 may be any suitable device such as, for example, infra-red emitters, liquified-gas burning flames manifolds, hot-air jots, lasers, ultrasound transducers, microwave sources, heated steel bars and heated steel rolls or the like.

The melting energy is applied onto the activatable layer or layers 26 of the wrapping material 12 that in this manner are converted to the molten state, thus attaining the adhesive property.

The paper rolls to be wrapped typically have a diameter of 500 . . . 1800 mm and width of 500 . . . 3000 mm. In the planning of the power output profile capabilities of the melting unit a crucial design factor is how rapidly the power output profile can be widened toward the edges when the smallest possible roll (minimum size roll) is followed by the largest possible roll (maximum size roll).

Wrapping speed on the wrapping lines is 0.6 . . . 1.5 m/s. The cycle time varies in the range of 20 . . . 60 s, most commonly in the range of 25 . . . 35 s. The power output is preferably designed for melting a wrapper web travelling at 1.5 m/s speed. The melting assembly is employed to apply a heating power of approx. 25 . . . 50 W per cm square onto the wrapper web. Then, the wrapper consumption is 17 m wrapper web on a maximum size roll (using three wrapper turns). Time used for wrapping in this case is approx. 11 s plus the transfer and positioning times of the crimping elements.

When necessary the set wrapping speed can be slightly reduced, because the above described gluing method facilitates an appreciably enlarged adherence area and thus a stiffer packaging. Consequently, also the number of wrapper turns can be reduced thus keeping the cycle time unchanged.

The underside portion of the melting unit can be replaced by a separate reflector, which by the same token improves the focusing of the thermal energy onto the plastic film laminate of the wrapping material. When a melting unit 31 comprised of infra-red radiators is employed, the reflector can typically be constructed from a suitable sheet metal or ceramic material.

The wrapper web 12 is severed either by stopping the travel of the web 12 and cutting the web, or alternatively, by hitting the web over the entire machine width with a blade, whereby the web is severed while travelling at full speed. The crimping arms 11 and header holding arms 15 are raised to their home positions after completion of wrapping, and the roll travels on the stepper conveyor 16 to the attachment of the outer headers.

The pressing station performs the attachment of the outer headers to the ends of the paper roll. The headers are placed on the pressing platens 17 either manually or with the help of a manipulator. After this, the pressing platens 17 rotate onto the support rolls and reach against the roll ends simultaneously heating the PE laminate layer on the inside of the headers. The headers are sealed to the roll when their PE laminate layer is heated to approx. 200° C. with the help of the pressing platens. The entire pressing takes about 5 . . . 10 s.

The packaging line also includes an apparatus for sticking labels to the roll surface. The labelling apparatus is placed according to system layout either at the wrapping station 9, the pressing station 6 or any station following the pressing station.

Some packaging schemes also require a stripe marking apparatus, which is used for painting one or more colour stripes to the side of the package. The purpose of the stripes is to indicate, for example, that two rolls are wrapped in a single package.

In addition to those described above, the present invention can have alternative embodiments different from the exemplifying embodiment described above.

For example, as already mentioned, the zonal control can be implemented using other control means than input power control. Instead of polyethylene, the wrapper web can be laminated with some other kind of polyolefin or any other suitable plastic material or even wax.

Figure 3A:
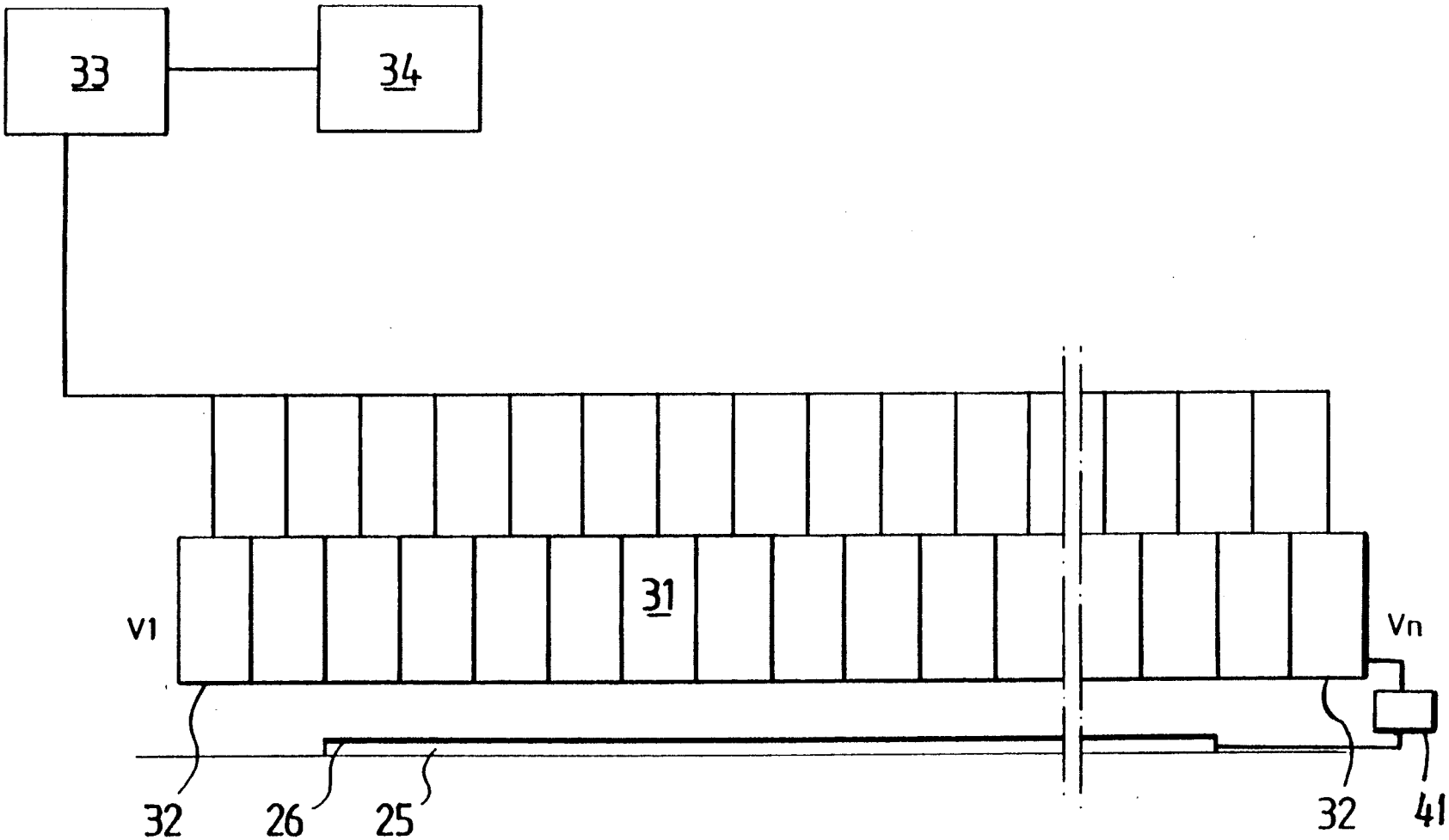
FIG. 3A illustrates diagrammatically another embodiment including a means for adjusting the distance between the melting zones and the wrapper material.
Figure 3B:
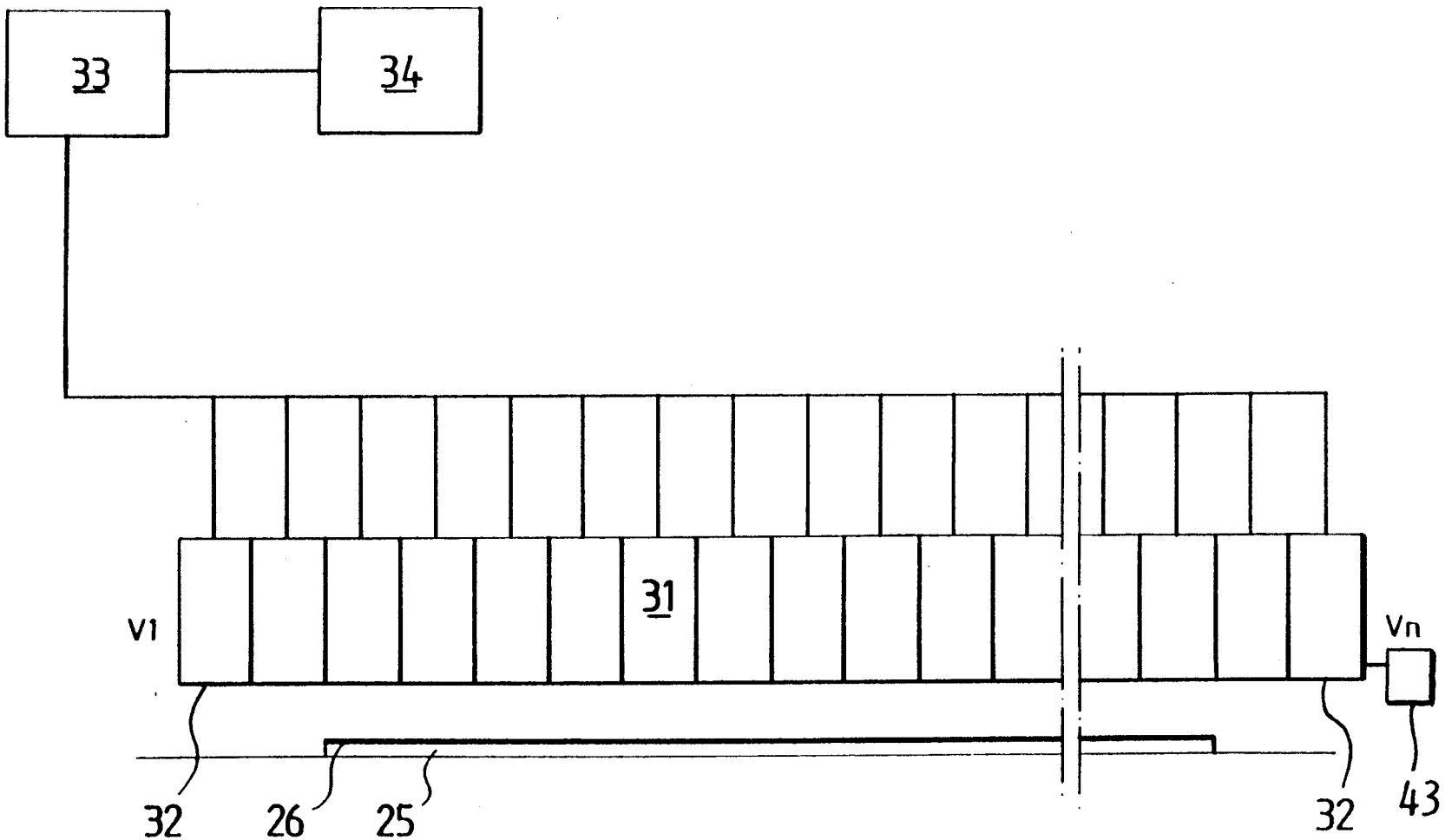
FIG. 3B illustrates diagrammatically a further embodiment including a means for adjusting the distance between the melting zones and the roll.
Figure 3C:
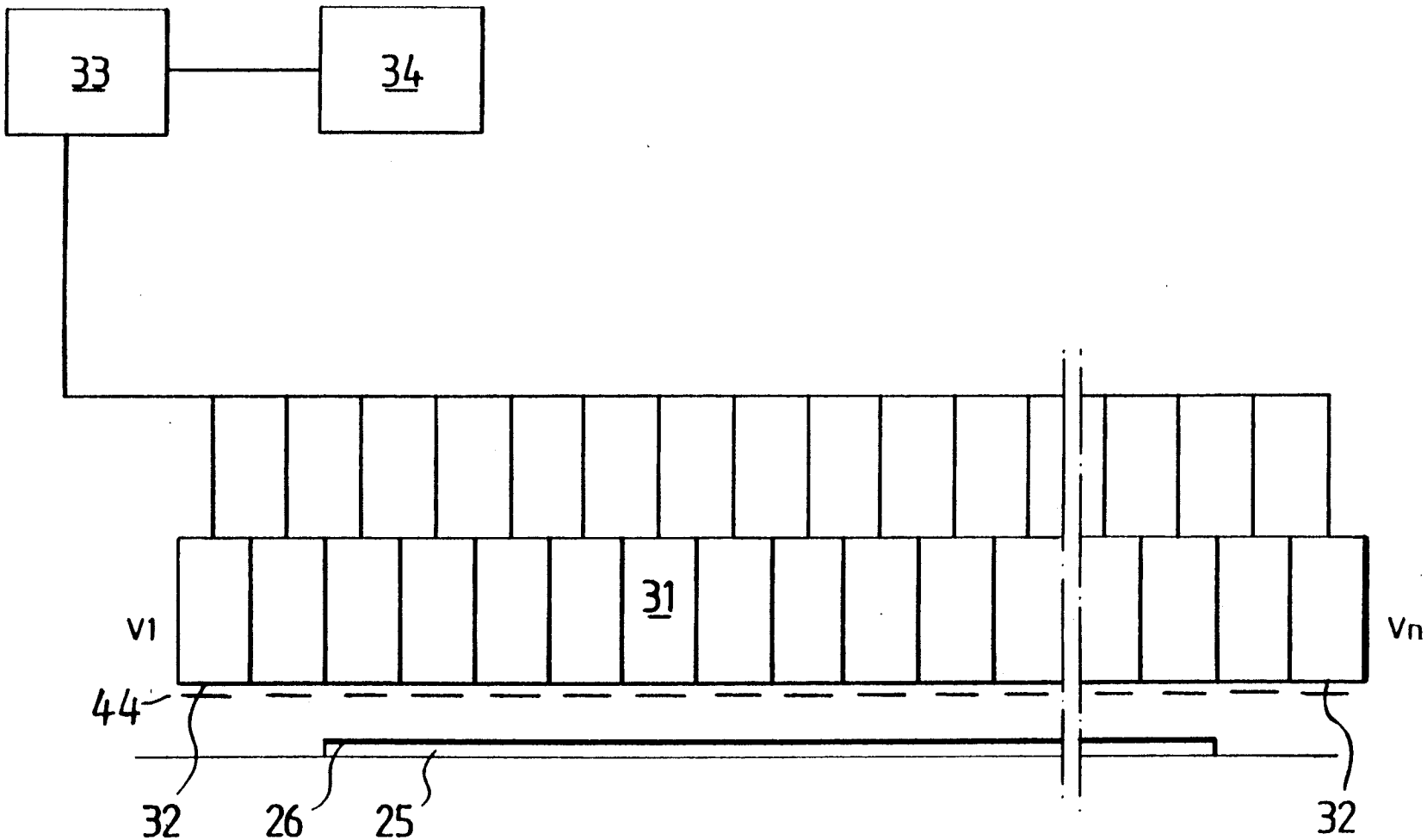
FIG. 3C illustrates diagrammatically still yet another embodiment comprising plural shading means.
Figure 3D:
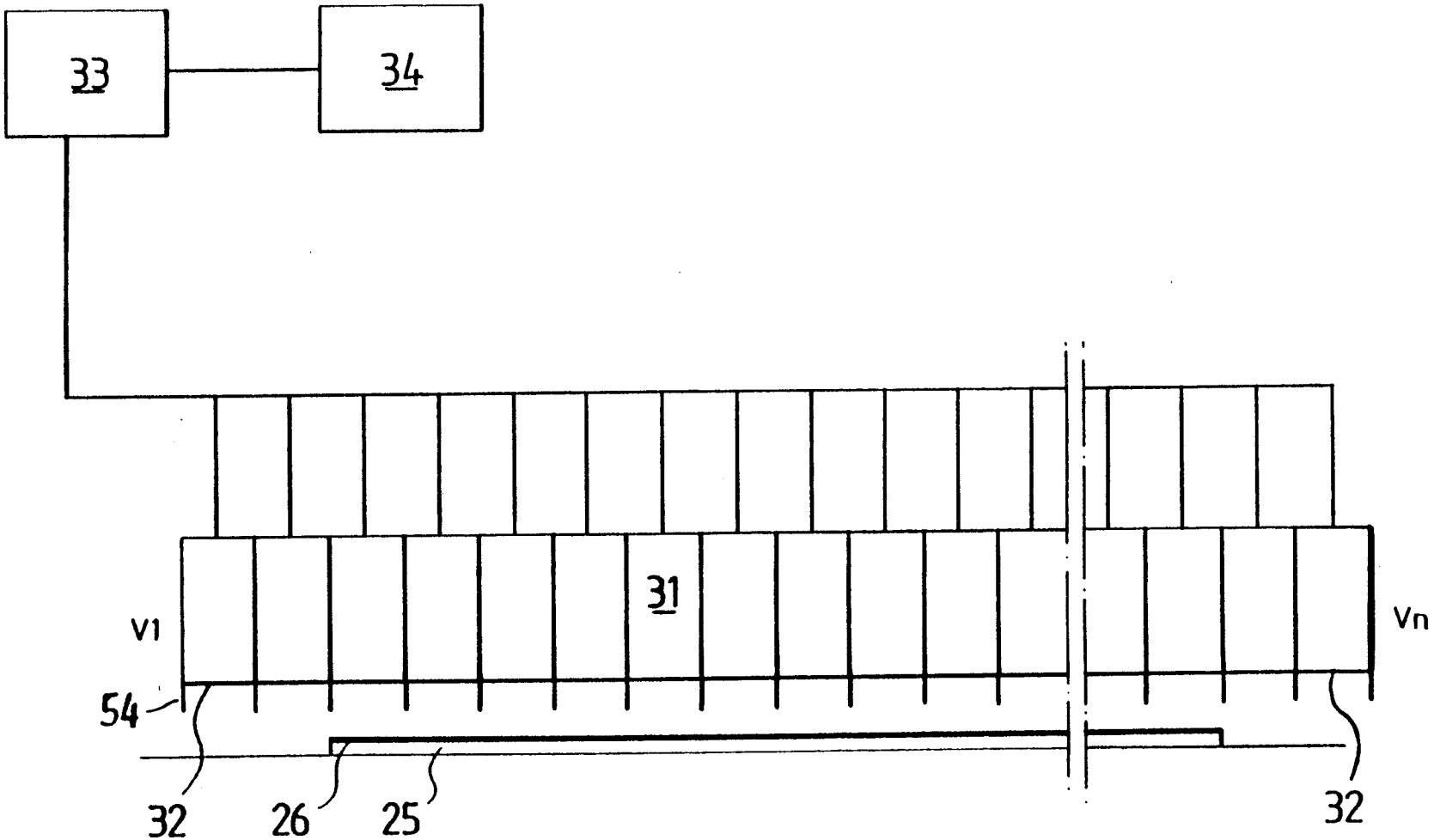
FIG. 3D illustrates diagrammatically still yet a further embodiment including plural deflecting elements.

Additionally, the control of the melting zones 31 can be effectuated by any suitable means 41 for controlling the distance between the melting zones and the wrapper material, as diagrammatically shown in FIG. 3A. In another embodiment, the control of the melting zones can be effectuated by any suitable means 43 for adjusting the distance between the melting zones and the roll, as diagrammatically shown in FIG. 3B. In a further embodiment, shading elements 44 are provided for controlling the melting zones 31, as diagrammatically shown in FIG. 3C. FIG. 3D illustrates another embodiment having deflecting elements 45 for controlling the melting zones 31. These means are conventionally known in the art for controlling the melting zones.

What is claimed is:

1. A method for wrapping a roll in a wrapper material having a width and a side coated with a laminate layer comprising a heat-meltable material, said method comprising the steps of:

(A) applying energy to the coated side of the wrapper material to at least partially melt the laminate layer along at least a portion of the width of the wrapper material from a start end to a finish end of the wrapper material;

(B) rotating the roll about a central axis of the roll while guiding the wrapper material melted in said step (A) into circumferential abutment with and about the roll from the start end to the finish end of the wrapper material so that the wrapper material adheres to the roll along the at least a portion of the width of the wrapper material and continuously from the start end to the finish end of the wrapper material, to thereby circumferentially wrap the roll in the wrapper material; and (C) severing the wrapper material at the finish end upon completion of said circumferential wrapping of the roll in the wrapper material.

2. The method according to claim 1, wherein the heat-meltable material comprises a heat-activatable material selected from the group consisting of wax and a plastic film.

3. The method according to claim 1, wherein the heat-meltable material comprises a polyethylene film.

4. The method according to claim 1, wherein the wrapper is adhered during a first revolution of the roll only at portion along the width of the wrapper material.

5. The method according to claim 4, wherein the wrapper is adhered during a second revolution and a third revolution of the roll over substantially the entire width of the wrapper material.

6. A method according to claim 1, wherein the roll comprises a paper roll.

7. An apparatus for wrapping a roll with a wrapper material having a width and a side coated with a laminate layer comprising a heat-meltable material, said apparatus comprising:

means for rotating the roll about its central axis;

means for guiding the wrapper material about the roll to be wrapped;

means for adhering the wrapper material to the surface of the roll to be wrapped, said means for adhering comprising a melting unit having at least two melting zones, said two melting zones being independently controllable from each other and being directed in confronting opposition to the coated side of the wrapper material so as to cause at least partial melting of the laminate layer along at least a portion of the width of the wrapper material; and means for severing the wrapper material upon completion of wrapping of the adhering wrapper material about the roll.

8. The apparatus according to claim 7, wherein said melting zones are arranged adjacent to each other in a direction along the central axis of the roll.

9. The apparatus according to claim 7, wherein said melting zones comprise control means for adjusting in the direction of the central axis of the roll to be wrapped a thermal effect imposed by the melting zones on the wrapping material so as to cause a desired melting pattern.

10. The apparatus according to claim 9, wherein said control means of said melting zones comprise a plurality of input power controllers.

11. The apparatus according to claim 9, wherein said control means of said melting zones comprise means for adjusting a distance between said melting zones and the wrapper material.

12. The apparatus according to claim 9, wherein said control means of said melting zones comprise means for adjusting a distance between said melting zones and the roll to be wrapped.

13. The apparatus according to claim 9, wherein said control means of said melting zones comprise a plurality of shading elements arranged between said melting zones and the wrapper material.

14. The apparatus according to claim 9, wherein said control means of said melting zones comprise a plurality of deflecting elements arranged between said melting zones and the wrapper material.

15. The apparatus according to claim 7, wherein said melting zones are arranged to heat the wrapper material on a side facing the laminate layer.

16. The apparatus according to claim 7, wherein said melting zones comprise heating means selected from the group consisting of infra-red emitters, liquified-gas burning flame manifolds, hot-air jets, lasers, ultrasound transducers, microwave sources, heated steel bars and heated steel rolls.

17. The apparatus according to claim 7, wherein the roll comprises a paper roll.

18. The apparatus according to claim 7, wherein the number of said melting zones is in the range of from 5 to 50.

19. A method for wrapping a roll in a wrapper material having a width and a side coated with a laminate layer comprising a heat-meltable material, said method comprising the steps of:

(A) advancing the wrapper material across an energy supplying means so as to apply energy to the coated side of the wrapper material for at least partially melting the laminate layer along at least a portion of the width of the wrapper material from a start end to a finish end of the wrapper material;

(B) varying the portion of the wrapper material width to which the melting energy is applied in said step (A) as the wrapper material is advanced across the energy applying source means so as to vary the portion of the wrapper material width along which the laminate layer is at least partially melted;

(C) rotating the roll about a central axis of the roll while guiding the wrapper material melted in said step (A) into circumferential abutment with and about the roll from the start end to the finish end of the wrapper material so that the wrapper material adheres to the roll along the at least a portion of the width of the wrapper material and continuously from the start end to the finish end of the wrapper material, to thereby circumferentially wrap the roll in the wrapper material; and (D) severing the wrapper material at the finish end upon completion of said circumferential wrapping of the roll in the wrapper material.

20. A method for wrapping a roll in a wrapper material having a width and a side coated with a laminate layer comprising a heat-meltable material, said method comprising the steps of:

(A) advancing the wrapper material across an energy supplying means so as to apply energy to the coated side of the wrapper material for at least partially melting the laminate layer along at least a portion of the width of the wrapper material from a start end to a finish end of the wrapper material;

(B) varying the amount of melting energy applied in said step (A) along the width of the wrapper material as the wrapper material is advanced across the energy applying source means so as to vary the portion of the wrapper material width along which the laminate layer is at least partially melted;

(C) rotating the roll about a central axis of the roll while guiding the wrapper material melted in said applying step into circumferential abutment with and about the roll from the start end to the finish end of the wrapper material so that the wrapper material adheres to the roll along the at least a portion of the width of the wrapper material and continuously from the start end to the finish end of the wrapper material, to thereby circumferentially wrap the roll in the wrapper material; and (D) severing the wrapper material at the finish end upon completion of said circumferential wrapping of the roll in the wrapper material.

21. An apparatus for wrapping a roll with a wrapper material having a width and a side coated with a laminate layer comprising a heat meltable material, said assembly comprising:

means for rotating the roll about its central axis;

at least one wrapper material roll for carrying the wrapper material;

means for guiding the wrapper material about the roll to be wrapped from said at least one wrapper material roll, said wrapper material roll being rotatable about the central axis of the roll;

means for adhering the wrapper material to the surface of the roll to be wrapped, said means for adhering comprising a melting unit having at least two melting zones, said two melting zones being independently controllable from each other and being directed in confronting opposition to the coated side of the wrapper material so as to cause at least partial melting of the laminate layer along at least a portion of the width of the wrapper material; and means for severing the wrapper material upon completion of wrapping of the adhering wrapper material about the roll.

22. The apparatus according to claim 21, wherein said means for guiding the wrapper material comprise two pressing rolls forming a nip.

* * * * *

UNITED STATES PATENT AND TRADEMARK OFFICE

CERTIFICATE OF CORRECTION

PATENT NO. : 5,265,399

DATED : November 30, 1993

INVENTOR(S) : Tapio Niskanen, Hannu Nieminen

It is certified that error appears in the above-identified patent and that said Letters Patent is hereby corrected as shown below:

On the title page item [73] Assignee;

should read as follows:--Valmet Paper Machinery, Incorporated--

Signed and Sealed this

Twenty-fourth Day of May, 1994

Bruce Lehman

*Attest:*

BRUCE LEHMAN

*Attesting Officer*

*Commissioner of Patents and Trademarks*